US005402061A

United States Patent [19]

Marsh et al.

[11] Patent Number: 5,402,061

[45] Date of Patent: Mar. 28, 1995

[54] TEMPERATURE INDEPENDENT CURRENT SOURCE

[75] Inventors: James W. H. Marsh, Sherwood; Keith H. Lofstrom, Beaverton, both of Oreg.

[73] Assignee: Tektronix, Inc., Wilsonville, Oreg.

[21] Appl. No.: 106,006

[22] Filed: Aug. 13, 1993

[51] Int. Cl.[6] ..... G05F 3/16; G05F 3/20

[52] U.S. Cl. ..... 323/315

[58] Field of Search ..... 323/312, 315, 907

[56] References Cited

U.S. PATENT DOCUMENTS

| | | | |
|---|---|---|---|
| 4,091,321 | 5/1978 | Hanna . | |
| 4,390,829 | 6/1983 | Jarrett | 323/315 X |
| 4,460,865 | 7/1984 | Bynum et al. . | |
| 4,590,419 | 5/1986 | Moriarty . | |
| 4,603,291 | 7/1986 | Nelson . | |
| 4,714,872 | 12/1987 | Traa . | |
| 4,786,856 | 11/1988 | Metcalf et al. . | |
| 4,792,748 | 12/1988 | Thomas et al. . | |
| 4,882,533 | 11/1989 | Kelley . | |
| 5,263,713 | 11/1993 | Agiman | 323/312 X |

*Primary Examiner*—Steven L. Stephan
*Assistant Examiner*—E. To
*Attorney, Agent, or Firm*—Boulden G. Griffith

[57] ABSTRACT

An improvement is provided for current sources of the type having three transistors configured as follows: The bases of the first (Q1) and second (Q2) transistors are tied together. The collector of the first transistor (Q1) is coupled to a first voltage ($V_{CC}$,$V_{EE}$) via a first resistor (R1). The emitter of the first transistor (Q1) is coupled to a second voltage ($V_{EE}$,$V_{CC}$) via a second resistor (R2). The collector of the second transistor (Q2) produces the output current ($I_{OUT}$). The emitter of the second transistor (Q2) is coupled to the second voltage ($V_{EE}$,$V_{CC}$) via a third resistor (R3). The base of the third transistor (Q3) is coupled, either directly or indirectly through a fourth transistor (Q4), to the collector of the first transistor (Q1). The collector of the third transistor (Q3) is connected to the first voltage ($V_{CC}$,$V_{EE}$) and the emitter of that transistor (Q3) is connected to the bases of the first (Q1) and second (Q2) transistors. The improvement consists of a fourth resistor (R5) coupled between the base and the emitter of the first transistor (Q1), the fourth transistor preferably having a value that is one half of the value of the first resistor (R1) when no fourth transistor (Q4) is present and having a value that is equal to the value of the first resistor (R1) when a fourth transistor (Q4) is in the base path of the third transistor (Q3).

2 Claims, 2 Drawing Sheets

TEMPERATURE INDEPENDENT CURRENT SOURCE

FIELD OF THE INVENTION

This invention relates to electrical current sources, and more particularly to a current source whose output is inherently compensated for the effects of changes in temperature.

BACKGROUND OF THE INVENTION

FIG. 1 shows one example of a conventional current source according to the prior art. The collector of a first NPN transistor Q1 is coupled to a relatively positive voltage reference $V_{CC}$ via collector resistor R1. The emitter of transistor Q1 is coupled to ground through R2. Ground acts as a second voltage reference $V_{EE}$. The base of transistor Q1 is connected to the base of a second NPN transistor Q2. The emitter of Q2 is coupled to $V_{EE}$/ground through another emitter resister R3. An optional reference resistor R4 may be used to connect the bases of Q1 and Q2 to $V_{EE}$/ground. Emitter following feedback transistor Q3 couples the collector of Q1 back to the base of Q1. The collector of Q3 is connected to $V_{CC}$. The output current is provided at the collector of Q2.

If the assumption is made that transistors Q1 and Q2 have equal $V_{BE}$'s, and the further simplifying assumption is made that the beta of all of the transistors are equal to infinity, then the currents $I_{REF}$ and $I_{OUT}$, flowing respectively through transistors Q1 and Q2, are determined as follows:

$$I_{OUT} = \frac{R2}{R3} * I_{REF} \tag{1}$$

where $$I_{REF} = \frac{V_{CC} - 2V_{BE}}{R1 + R2} \tag{2}$$

As can be seen from these relationships, the output current is directly dependent on $V_{BE}$, since the reference current $I_{REF}$ is dependent on $V_{BE}$ and the output current $I_{OUT}$ is proportional to the reference current $I_{REF}$. It would be very desirable to eliminate this dependence without adding any complex or expensive circuitry.

U.S. Pat. No. 4,714,872 to Traa for a "Voltage Reference for Transistor Constant Current Source", hereby incorporated by reference, discloses a voltage reference circuit for a constant current source bipolar transistor. One of the two voltages produced by this circuit varies with the negative temperature coefficient, i.e., $V_{BE}$, of a bipolar transistor. The other voltage produced by this circuit has a constant magnitude that is independent of supply variations. The reference voltages produced by this circuit thus allow a constant current source to operate independently of both temperature variations and supply variations. However, this circuit is quite complex and therefore relatively expensive, thus limiting its usefulness for some applications.

U.S. Pat. No. 4,792,748 to Thomas et al. for a "Two-Terminal Temperature-Compensated Current Source Circuit", hereby incorporated by reference, discloses a reference current source in which plus and minus temperature correction currents are summed to produce a final reference current whose temperature dependence can be selected to be zero or a range of plus or minus values, depending on the selection of two resistor values. U.S. Pat. No. 4,460,865 to Bynum et al. for "Variable Temperature Coefficient Level Shifting Circuit and Method", hereby incorporated by reference, discloses a similar approach.

SUMMARY OF THE INVENTION

The invention provides an improvement for current sources of the type having three transistors configured as follows: The bases of the first and second transistors are tied together. The collector of the first transistor is coupled to a first voltage via a first resistor. The emitter of the first transistor is coupled to a second voltage via a second resistor. The collector of the second transistor produces the output current. The emitter of the second transistor is coupled to the second voltage via a third resistor. The base of the third transistor is coupled, either directly or indirectly through a fourth transistor, to the collector of the first transistor. The collector of the third transistor is connected to the first voltage and the emitter of that transistor is connected to the bases of the first and second transistors. The improvement, which makes the circuit's current output virtually independent of temperature changes, consists of a fourth resistor coupled between the base and the emitter of the first transistor, the fourth transistor preferably having a value that is one half of the value of the first resistor when no fourth transistor is present and having a value that is equal to the value of the first resistor when a fourth transistor is in the base path of the third transistor.

DETAILED DESCRIPTION OF THE INVENTION

Figure 1:
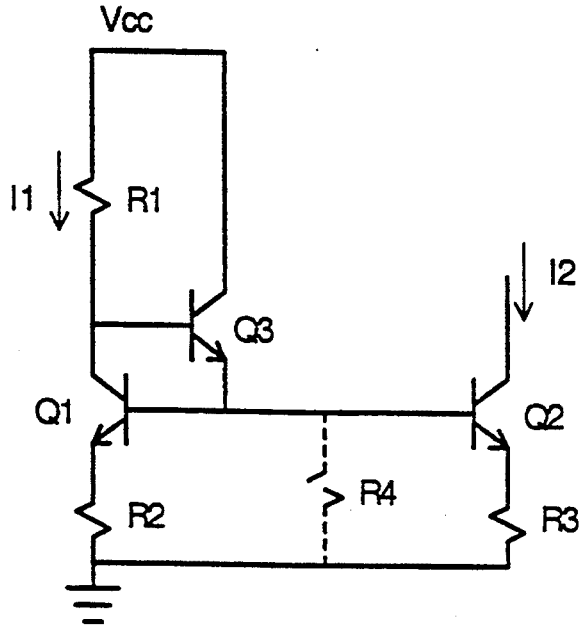
FIGURE 1 PRIOR ART
FIG. 1 is a schematic diagram of a prior art current source, the output of which is dependent on temperature.
Figure 2:
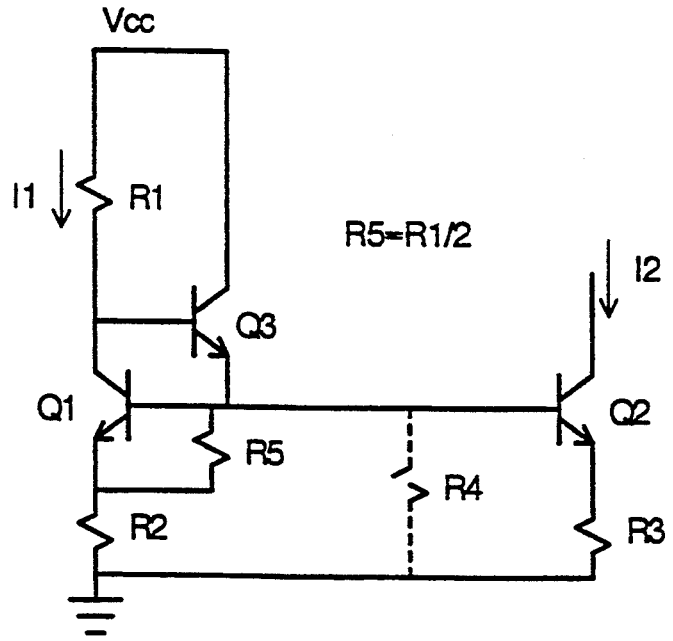
FIG. 2 is a schematic diagram of the temperature independent current source of the present invention in its NPN embodiment.

FIG. 2 shows an NPN embodiment of the temperature independent current source of the present invention. The independence from temperature has been attained by adding base-to-emitter resistor R5 to the circuitry shown in FIG. 1. The addition of this resistor alters the dependence of the reference current $I_{REF}$ and output current $I_{OUT}$ as follows:

$$I_{REF} = \frac{V_{CC}}{(R1 + R2)} - \frac{V_{BE} * \left(2 + \frac{R2}{R5}\right)}{(R1 + R2)} \tag{3}$$

$$I_{OUT} = \frac{R2}{R3} * \left(I_{REF} + \frac{V_{BE}}{R5}\right) \tag{4}$$

Since by appropriate selection of a process for implementing the resistors the temperature dependence of all of the resistors involved can be quite successfully minimized, for the purpose of analysis we can make the convenient assumption that the temperature dependence of the resistors is negligible, i.e., zero. Additionally, for the purpose of this analysis, we also assume that $V_{CC}$ is temperature independent.

By taking the partial derivative of equation (4) with respect to temperature and setting the result equal to zero we can obtain equation (5):

$$\frac{d}{dT}\left(I_{REF}+\frac{V_{BE}}{R5}\right)=0 \tag{5}$$

By substituting equation (3) for $I_{REF}$ in equation (5), the result seen in equation (6) can be obtained:

$$\frac{d}{dT}\left(\frac{V_{CC}}{(R1+R2)}-\frac{V_{BE}*\left(2+\frac{R2}{R5}\right)}{(R1+R2)}+\frac{V_{BE}}{R5}\right)=0 \tag{6}$$

Recognizing that the temperature dependence of the first term of this expression must be zero because of the simplifying assumptions described above, it can be seen that multiplying the remaining terms by $1/V_{BE}$ produces equation (7):

$$\frac{1}{R5}-\left(2+\frac{R2}{R5}\right)\frac{1}{R1+R2}=0 \tag{7}$$

Equation (7) can be solved for R5 to produce equation (8):

$$R5=\frac{R1}{2} \tag{8}$$

The temperature independent output current $I_{OUT}$ can then be obtained by substituting equation (3) into equation (4) and then substituting equation (8) into the result to produce equation (9):

$$I_{OUT}=\frac{R2}{R3}*V_{CC}*\frac{R1}{R2} \tag{9}$$

Figure 3:
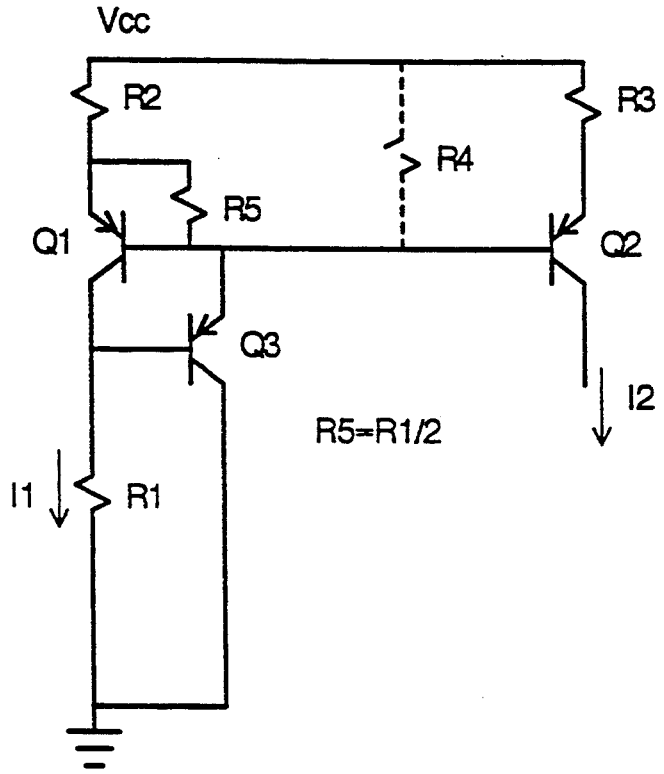
FIG. 3 is a schematic diagram of a PNP version of the temperature independent current source of the present invention.

FIG. 3 is a schematic diagram of a PNP version of the temperature independent current source of the present invention. The theoretical behavior of this circuit is also described by equation (9), except that when lateral PNP transistors are used the assumption of infinite beta (described above in connection with equations (1) and (2)) does not hold.

Figure 4:
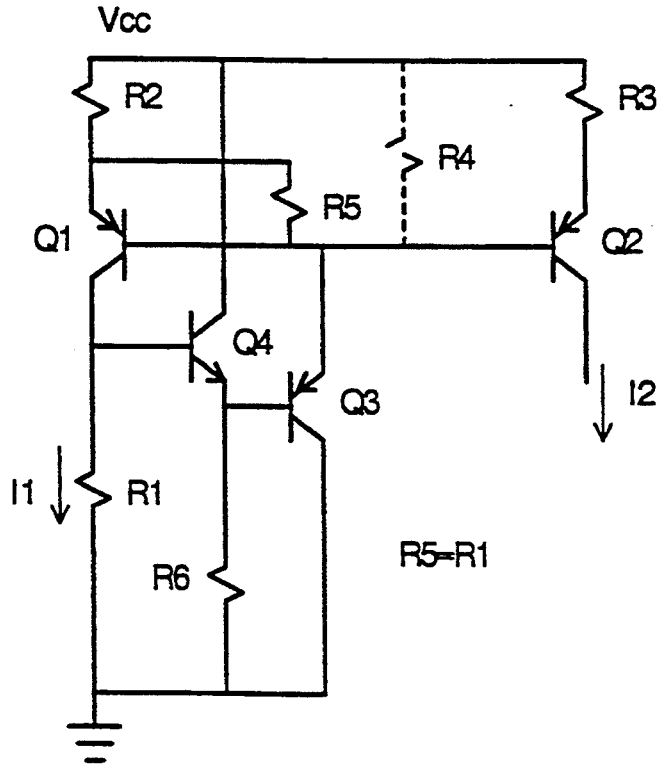
FIG. 4 is a schematic diagram of a hybrid PNP/NPN version of the current source of the present invention.

FIG. 4 is a schematic diagram of a hybrid PNP/NPN version of the current source of the present invention. The NPN transistor Q4 supplies a high beta and serves as an emitter follower to supply a relatively large base current required by Q3 while ensuring the accuracy of the reference current $I_{REF}$ into the current mirror. Analysis of the circuit shown in FIG. 4 produces equations (10) and (11):

$$I_{REF}=\frac{V_{CC}}{R1+R2}-\left(1+\frac{R2}{R5}\right)*V_{BE}*\frac{R1}{R2} \tag{10}$$

$$I_{OUT}=\frac{R2}{R3}*\left(I_{REF}+\frac{V_{BE}}{R5}\right) \tag{11}$$

These equations produce a temperature independent output when R5=R1. This result, which is different than the result for the circuit shown in FIG. 3, is due to the fact that only one net base-emitter junction exists in the reference side of the current mirror. In general, the number n of net base-emitter junctions in the reference side of the current mirror determines that relationship between R1 and R5 according to equation (12):

$$R5=\frac{R1}{n} \tag{12}$$

While a preferred embodiment of the present invention has been shown and described, it will be apparent to those skilled in the art that many changes and modifications may be made without departing from the invention in its broader aspects. The claims that follow are therefore intended to cover all such changes and modifications as fall within the true scope and spirit of the invention.

I claim:

1. An improved current source of the type having:
   - a first (Q1) transistor, the first transistor having a controlling terminal and first and second controlled terminals;
   - a second (Q2) transistor, the second transistor having a controlling terminal and first and second controlled terminals, with the controlling terminal of the second transistor being connected to the controlling terminal of the first transistor (Q1) and the first controlled terminal of the second transistor producing an output current ($I_{OUT}$);
   - a first resistor (R1) coupled between the first controlled terminal of the first transistor (Q1) and a first voltage ($V_{CC}$,$V_{EE}$);
   - a second resistor (R2) coupled between the second controlled terminal of the first transistor (Q1) and a second voltage ($V_{EE}$,$V_{CC}$);
   - a third resistor (R3) coupled between the second controlled terminal of the second transistor (Q2) and the second voltage ($V_{EE}$,$V_{CC}$);
   - a third transistor (Q3), the third transistor having a controlling terminal and first and second controlled terminals with the controlling terminal of the third transistor coupled to the first controlled terminal of the first transistor (Q1), the first controlled terminal of the third transistor being coupled to the first voltage ($V_{CC}$,$V_{EE}$), and the second controlled terminal of the third transistor being coupled to the controlling terminals of the first (Q1) and second (Q2) transistors;
   - a fourth resistor (R5) coupled between the controlling terminal and the second controlled terminal of the first (Q1) transistor;
   - a fourth transistor (Q4), the fourth transistor having a controlling terminal and first and second controlled terminals, with the controlling terminal of the fourth transistor connected to the first controlled terminal of the first transistor (Q1), the first controlled terminal of the fourth transistor connected to the second voltage ($V_{CC}$), and the second controlled terminal of the fourth transistor being resistively coupled to the first voltage ($V_{EE}$); and
   - a fifth resistor (R6) coupled between the second controlled terminal of the fourth transistor and the first voltage source ($V_{CC}$).

2. An improved current source according to claim 1 wherein the fourth resistor (R5) has a value that is substantially equal to a value of the first resistor (R1).

* * * * *